United States Patent [19]

Ephraim

[11] 4,000,488

[45] Dec. 28, 1976

[54] LABEL ALARM SYSTEM

[76] Inventor: Bernard Ephraim, 4450 N. Clark St., Chicago, Ill. 60640

[22] Filed: Apr. 19, 1974

[21] Appl. No.: 462,245

[52] U.S. Cl. ..... 340/280; 174/68.5; 174/117 A

[51] Int. Cl.[2] ..... G08B 13/08; G08B 21/00

[58] Field of Search ..... 340/280, 256, 274; 200/61.08, 292; 339/278 R, 278 A; 317/101 F, 101 C, 101 A; 174/117 A, 68.5

[56] References Cited

UNITED STATES PATENTS

| | | | |
|---|---|---|---|
| 1,559,380 | 10/1925 | Roe | 174/117 A |
| 2,927,311 | 3/1960 | Donaldson | 340/280 |
| 3,072,500 | 1/1963 | Berlinghof | 200/61.08 |
| 3,253,270 | 5/1966 | Downer | 340/280 |
| 3,339,117 | 8/1967 | Fisher | 317/101 C |
| 3,440,636 | 4/1969 | Sliman | 340/280 |
| 3,544,984 | 12/1970 | Hanson | 340/280 |
| 3,634,845 | 1/1972 | Colman | 340/274 |
| 3,703,603 | 11/1972 | Levesoue et al. | 174/68.5 |
| 3,740,742 | 6/1973 | Thompson et al. | 340/280 |
| 3,742,480 | 6/1973 | Hoecker | 340/280 |
| 3,755,803 | 8/1973 | Cole et al. | 340/280 |
| 3,757,087 | 9/1973 | Bernard | 174/117 A |
| 3,851,326 | 11/1974 | Costa | 340/280 |

FOREIGN PATENTS OR APPLICATIONS

| | | | |
|---|---|---|---|
| 198,739 | 6/1923 | United Kingdom | 174/117 A |

*Primary Examiner*—Laramie E. Askin

[57] ABSTRACT

An anti-theft alarm system comprising an electric circuit including a signal device and electrical components in said circuit adapted to be attached to an article of merchandise and which are readily destructible to interrupt the circuit and actuate the signal device.

16 Claims, 5 Drawing Figures

Fig. 1.
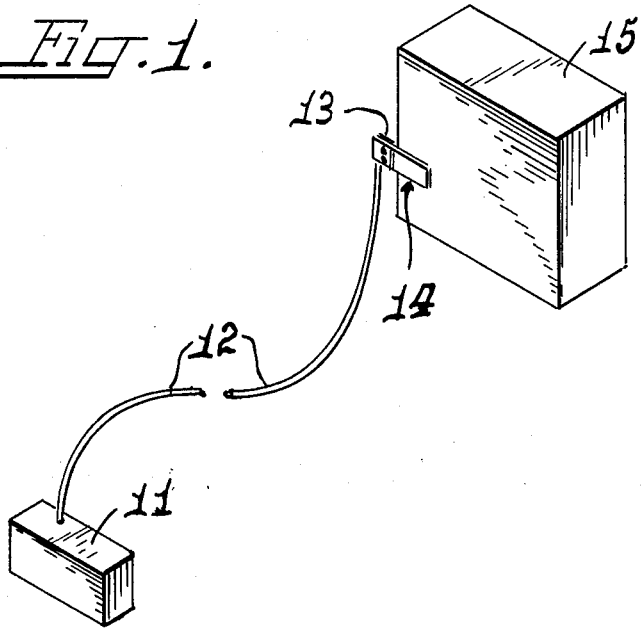
Fig. 2.
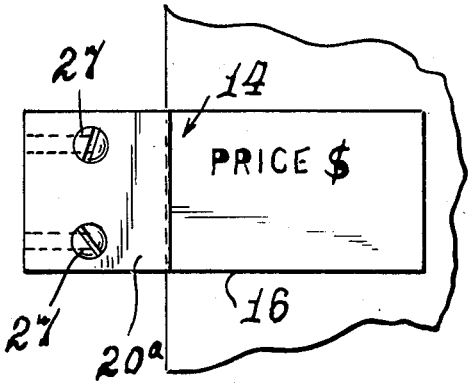
Fig. 4
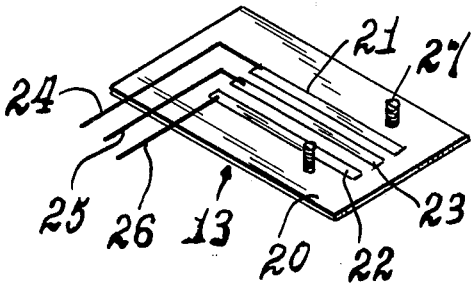
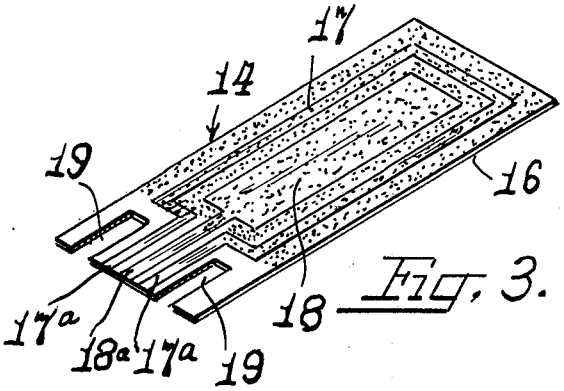
Fig. 3.
Fig. 5.
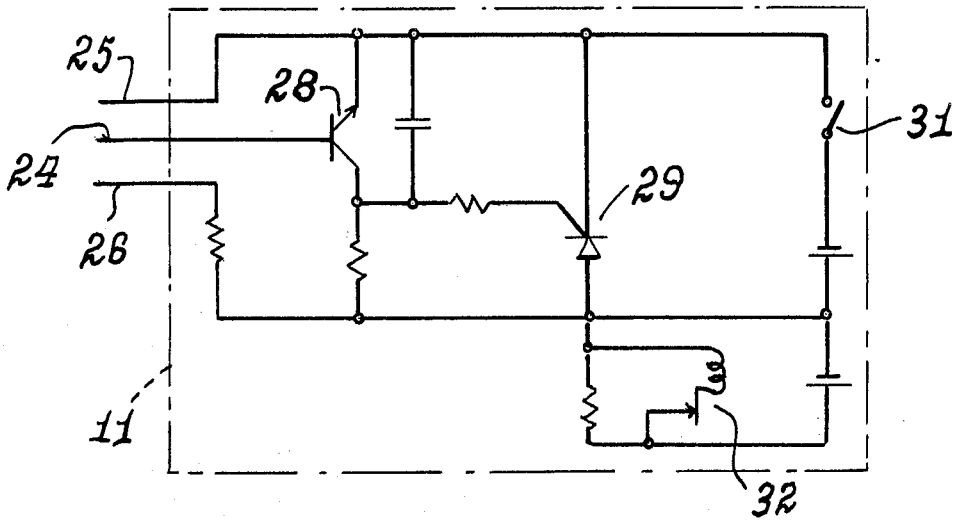

LABEL ALARM SYSTEM

BACKGROUND OF THE INVENTION

The invention relates to improvements in an anti-theft alarm system of a type that sounds an alarm when a label affixed to a product is torn, mutilated or cut during attempted removal of the label from the product.

SUMMARY OF THE INVENTION

More particularly, the system includes a label, which may bear price or other indicia, and which contains complementary portions of a closed electric circuit connected to a signal device; and when the label is torn, mutilated, cut or removed from the merchandise, the signal device is triggered.

It is the object of the invention to provide an anti-theft alarm system of the character referred to.

Another object is to provide in an electric alarm circuit a destructible element effective when destroyed to interrupt the circuit.

Another object is to provide an electric alarm circuit with a destructible component which may be adhesively secured to an article of merchandise.

Another object is to provide an adhesively coated label with electrical conductive elements forming a part thereof.

Another object of the invention is to provide an anti-theft alarm system which is not expensive to manufacture or use, and which is very effective in its Other objects and advantages of the invention will become apparent with reference to the following description and accompanying drawings.

BRIEF DESCRIPTION OF THE DRAWING

In the drawings:

FIG. 1 is a perspective view of the alarm system.

FIG. 2 is a top view of the label, showing it attached to an article of merchandise.

FIG. 3 is a perspective view of the back side of the label.

FIG. 4 is a perspective view of the connector with the cover plate removed.

FIG. 5 is a schematic view of the wiring in the signal housing.

DESCRIPTION OF THE PREFERRED EMBODIMENT

Referring to the exemplary embodiment of the invention shown in the accompanying drawings, the anti-theft alarm system includes a box or other housing 11 which contains an electrically actuated signal device. The signal device is electrically connected, through cable 12, with a connector 13, that is secured firmly to a label 14 of a kind adaptable to be adhesively secured to an article of merchandise.

The label 14, best shown in FIGS. 2 and 3, comprises a bendable sheet 16 of destructible material, such as paper, having printed or otherwise laid over and adhered to one face components 17 and 18 of an electric circuit. Preferably, component 17 comprises a portion of a conductive loop and component 18 is a common ground for the loop, as shown in FIG. 3. The major surface of the sheet which bears the circuitry is coated with an adhesive, normally covered by a removable covering sheet for ease of handling before application of the label (not shown). One end of the sheet 16 is formed with slots 19, opening onto said end, and the terminals **17*a* and 18*a* of the electric components 17 and 18 are arranged between said slots. In use, so far as described, the removable covering sheet is peeled from the label to expose the adhesive surface, and the adhesively coated surface of the sheet 16 is pressure secured to a surface of the article of merchandise 15**, with its slotted end portion free therefrom.

The connector 13 is comprised of a body 20, preferably of rigid material such as pressboard, phenolic or like electrically insulating material, having imprinted or otherwise provided on one surface a complemental set of electrical components 21 - 22 and 23, each connected by a line 24 – 26 and 25, respectively, to the circuitry in the box 11. The body 20 carries a pair of fastening screws 27, which when the body 20 is laid under the free end portion of sheet 16, with its components 21 – 22 and 23 in face to face contact with the terminal ends **17*a* and 18*a* of components 17 and 18, respectively, enter the respective slots 19, and when tightened securely lock the connector 13 to the label 14. A cover plate 20*a* may be secured over the connection by said screws 27** to complete the installation.

Referring now to the circuit shown in box 11, a common transistor 28 is coupled with a silicon-controlled rectifier (SCR) 29, which is triggered by switch 31. The switch 31 is provided to turn the alarm system off; and when closed the switch resets the alarm system. The lead 24 forms part of the protective circuit 25 – 26 to thereby effectively apply triggering voltage on the SCR 29, to fire the device through common circuitry and activate the alarm 32. Similarly, severing the normally closed circuit of components 17 and 18 will destroy the circuitry within the printed label 14 and also fire the SCR and sound the alarm 32.

Preferably, the components 17, **17*a*, 18 and 18*a* are printed on the sheet 16 of label 14 with conductive ink, or they may comprise strips of conductive foil or similar conductive material in the configuration of the circuit. Preferably, the components 21 – 22 and 23 of the connector 13 are etched metallic printed circuitry or other material having a longer useful life than the label materials, to permit re-use of the connector after the label circuit has been destroyed. The cable 12 is preferably a multiple wire shielded conductor containing lines 24, 25 and 26**.

Once the alarm system is activated, any attempt to cut or tear the label or to cut the cable or remove the label from the connector will cause the alarm to sound. Since the label circuitry components are adhered to the sheet and then pressure sensitively secured to the merchandise, any attempt to peel the label from the merchandise will leave portions of the components secured to the adhesive and break the circuit to cause the alarm to sound. Likewise, any attempt to ground or short the center sections 18 and **18*a* and 25 to either components 17 or 17*a* or lines 24, 26** will ground the circuit internally and sound the alarm.

While only a single label - connector assembly is illustrated, several such label - connector assemblies may be used with a single alarm circuit by utilizing conventional connections.

Although I have described a preferred embodiment of my invention in considerable detail, it will be understood that the description thereof is intended to be illustrative rather than restrictive, as details of the structure may be modified or changed without departing from the spirit or scope of the invention. Accordingly, I do not desire to be restricted to the exact construction described and shown.

I claim:

1. A label comprised of a sheet of readily destructible insulation material, electric circuit components on one surface thereof, one of said components comprising a portion of a conductive loop having two terminals adaptable for attachment to an electric circuit, another component comprising a conductor out of contact with the loop and having a terminal adaptable for attachment to said circuit, and an adhesive coating said one surface and said components.

2. The label recited in claim 1, wherein said conductor component is located within said loop portion and comprises a ground.

3. The label recited in claim 1, wherein all of said terminals are on said surface at one end of said sheet.

4. The label recited in claim 3, wherein said end is free of adhesive.

5. The label recited in claim 3, wherein said end is slotted.

6. The label recited in claim 5, wherein said slotted end has a pair of slots and said terminals are located therebetween.

7. The label recited in claim 1, wherein said sheet of insulation material comprises paper.

8. The label recited in claim 1, wherein said components comprise conductive ink printed on said sheet.

9. The label recited in claim 1, wherein said components comprise strips of conductive material bonded to said sheet.

10. The label recited in claim 1, wherein said adhesive is pressure sensitive.

11. The label recited in claim 1, wherein said adhesive coated surface is covered by a removable covering sheet.

12. A label alarm system comprising an electrically actuated signal device having a normally closed electric circuit, a label adhesively secured to an article of merchandise, means removably securing said label to said signal device, electric circuit components on said label and said removable securing means therefor, and means connecting said components in said circuit, said label components including a portion of a conductive loop having two terminals and another conductor out of contact with said loop and being destructible to interrupt the current to the circuit for actuating the signal device upon removal of the label from said merchandise, at least one surface of said label and said label components being coated by the adhesive.

13. The alarm system recited in claim 12, in which the signal device is an audible alarm.

14. The alarm system recited in claim 12, in which the signal device is remotely located relative to the label.

15. In a label and connector adapted for use in a label alarm system including an electrically actuated signal device, said label comprising a sheet of material having electric circuit components and an adhesive coating on one surface thereof adaptable for securing said label to an article of merchandise, and said connector being detachably secured to said label for electrically connecting said circuit components to said signal device, said components including a portion of a conductive loop having two terminals and another conductor out of contact with said loop, said adhesive coating being disposed on at least one surface of said components.

16. The label and connector recited in claim 15, in which one end of the label is slotted and said connector is secured to said slotted end.

* * * * *